US005881510A

United States Patent [19]

Ole

[11] Patent Number: 5,881,510

[45] Date of Patent: Mar. 16, 1999

[54] WINDOW FRAME DEVICE

[75] Inventor: James Ole, Geneseo, Ill.

[73] Assignee: The Kewanee Corporation, Kewanee, Ill.

[21] Appl. No.: 961,684

[22] Filed: Oct. 31, 1997

[51] Int. Cl.[6] ..... E06B 1/04

[52] U.S. Cl. ..... 52/217; 52/212; 52/213; 52/204.54; 52/204.56

[58] Field of Search ..... 52/204.5, 204.53–204.55, 52/204.591, 204.593, 204.595, 208, 204.62, 204.71, 213, 214, 212, 211

[56] References Cited

U.S. PATENT DOCUMENTS

| | | | |
|---|---|---|---|
| 4,986,044 | 1/1991 | Funari | 52/213 |
| 5,369,922 | 12/1994 | Hansen | 52/204.54 |
| 5,711,120 | 1/1998 | Karpen | 52/212 |

*Primary Examiner*—Christopher Kent
*Assistant Examiner*—Yvonne Horton-Richardson
*Attorney, Agent, or Firm*—Niro, Scavone, Haller & Niro

[57] ABSTRACT

A window frame device is disclosed for permitting the adjustable setting of a window frame adjacent to a foundation form. The device includes a window frame which has a head having a first and a second side, the first and second sides defining respectively a first and a second slot. A sill has a first and a second extremity, the first and second extremities defining respectively a first and a second channel. A first jamb extends between the first side of the head and the first extremity of the sill and a second jamb extends between the second side of the head and the second extremity of the sill. A first tie adapter has a first and a second end, the first end defining a tenon which cooperates with the first slot, the second end defining a tab which cooperates with the first channel. A second tie adapter has a first and a second edge, the first edge defining a further tenon which cooperates with the second slot. The second edge defines a further tab which cooperates with the second channel, the arrangement being such that when the tie adapters are located adjacent to the respective jambs with the tenons and tabs cooperating with the respective slots and channels, the adjustable setting of the window frame relative to the foundation form is permitted.

13 Claims, 3 Drawing Sheets

WINDOW FRAME DEVICE

BACKGROUND OF THE INVENTION

FIELD OF THE INVENTION

The present invention relates to a window frame device. More specifically, the present invention relates to a window frame device which permits the adjustable location of a window frame relative to a foundation form.

BACKGROUND OF THE INVENTION

In the building art, basement windows are often provided when the foundations are being poured.

Furthermore, in order to install the aforementioned basement windows, it has been customary to set up a wooden-foundation form work prior to pouring the concrete foundations.

Additionally, the basement window frame is usually located within the form work by nailing the head, sill and side members or jambs of the window frame to the wooden form work so that the window frame is correctly aligned and positioned prior to pouring the concrete foundations.

However, with the advent of metal foundation forms, builders have been unable to nail or otherwise fasten the basement window frame to the metal form.

Also, with the use of metal forms, it would not be practical to drill the metal form in order to provide a fastener for fastening and locating the window frame.

Additionally, even if a fastener were to be provided, such fastener would have to be removed prior to the removal of the metal forms subsequent to the pouring operation.

The present invention overcomes the aforementioned problems associated with the prior art use of metal forms by the provision of unique tie adapters which cooperate with the window frame for permitting the window frame to be tied with form ties to the form work prior to pouring the concrete.

Also, due to the central location of the adapters, such adapters will become embedded in the concrete after the pour and so do not detract from the overall appearance of the subsequently set window frame.

Therefore, it is a primary objective of the present invention to provide a window frame device which overcomes the problems associated with the prior art arrangements and which makes a considerable contribution to the building art.

Other objects and advantages of the present invention will be readily apparent to those skilled in the art by a careful consideration of the detailed description of a preferred embodiment of the present invention taken in conjunction with the annexed drawings.

SUMMARY OF THE INVENTION

The present invention relates to a window frame device for permitting the adjustable setting of a window frame adjacent to a foundation form. The device comprises a window frame which includes a head having a first and a second side, the first and second sides defining respectively a first and a second slot.

A sill has a first and a second extremity, the first and second extremities defining respectively a first and a second channel.

A first jamb extends between the first side of the head and the first extremity of the sill.

A second jamb extends between the second side of the head and the second extremity of the sill.

A first tie adapter has a first and a second end, the first end defining a tenon which cooperates with the first slot. The second end defines a tab which cooperates with the first channel.

A second tie adapter has a first and a second edge, the first edge defining a further tenon which cooperates with the second slot. The second edge defines a further tab which cooperates with the second channel, the arrangement being such that when the tie adapters are located adjacent to the respective jambs with the tenons and tabs cooperating with the respective slots and channels, the adjustable setting of the window frame relative to the foundation form is permitted.

In a more specific embodiment of the present invention, the window frame device, the head, the sill and the jambs are metallic.

More particularly, the first slot extends in a direction from the first side of the head towards the second side thereof and the second slot extends in a direction from the first side of the head towards the second side thereof.

Also, the first channel extends in a direction from the first extremity of the sill towards the second extremity thereof and the second channel extends in a direction from the first extremity of the sill towards the second extremity thereof.

Additionally, each of the slots and the channels include an open end and a closed end. The open end of the first slot and the open end of the second slot are spaced apart by a first distance.

Also, the closed end of the first slot and the closed end of the second slot are spaced apart by a second distance, the first distance being greater than the second distance.

Moreover, the open end of the first channel and the open end of the second channel are spaced apart by a third distance.

Also, the closed end of the first channel and the closed end of the second channel are spaced apart by a fourth distance, the third distance being greater than the fourth distance.

Normally, the first and third distance are the same and the second and fourth distance are the same.

Additionally, the first tie adapter further includes a main portion and a stabilizer which extends angularly from the main portion, the stabilizer cooperating with and lying flat against the first jamb for stabilizing the main portion relative to the window frame.

Also, the main portion defines a plurality of holes disposed between the first and second end, the holes permitting the adjustable fastening of the main portion relative to the foundation form.

Similarly, the second tie adapter further includes a further main portion and a further stabilizer which extends angularly from the further main portion. The further stabilizer cooperates with and lies flat against the second jamb for stabilizing the further main portion relative to the window frame.

The further main portion defines a plurality of apertures disposed between the first and second edge, the apertures permitting the adjustable fastening of the further main portion relative to the foundation form.

In a specific embodiment, the present invention includes, a form tie adapter device for tying a basement window frame to a metal foundation form, the window frame including a head having a first and a second side and a sill having a first and a second extremity. The device comprises a first adapter having a first and a second end and an inner and an outer flank.

The first end further includes a tenon which cooperates with a first slot defined by the first side of the head.

The second end further includes a tab which cooperates with a first channel defined by the first extremity of the sill.

The first adapter further includes a main portion and a stabilizer which extends angularly from the inner flank for stabilizing the first adapter relative to the window frame.

The outer flank defines a plurality holes, the arrangement being such that the holes permit the location and securing of the window frame relative to the foundation form.

A second adapter has a first and a second edge and a further inner and a further outer flank.

The first edge further includes a further tenon which cooperates with a second slot defined by the second side of the head.

Additionally, the second edge further includes a further tab which cooperates with a second channel defined by the second extremity of the sill.

The second adapter further includes a further main portion and a further stabilizer which extends angularly from the further inner flank for stabilizing the second adapter relative to the window frame.

Furthermore, the further outer flank defines a plurality of apertures, the arrangement being such that the apertures permit the location and securing of the window frame relative to the foundation form.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference numerals refer to similar parts throughout the various views of the drawings.

DETAILED DESCRIPTION OF THE DRAWINGS

Figure 1:
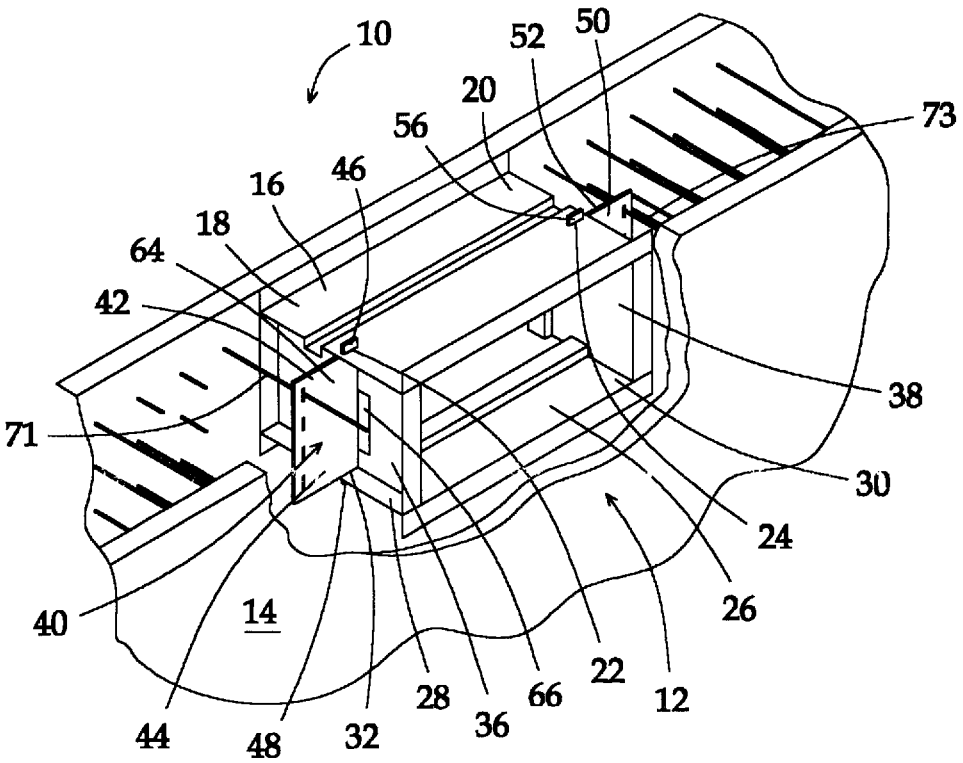
FIG. 1 is a perspective view of the window frame device according to the present invention.

FIG. 1 is a perspective view of a window frame device generally designated 10 according to the present invention for permitting the adjustable setting of a window frame generally designated 12 adjacent to a foundation form 14. The device 10 comprises the window frame 12 which includes a head 16 having a first and a second side 18 and 20 respectively. The first and second sides 18 and 20 defines respectively a first and a second slot 22 and 24 respectively.

Figure 2:
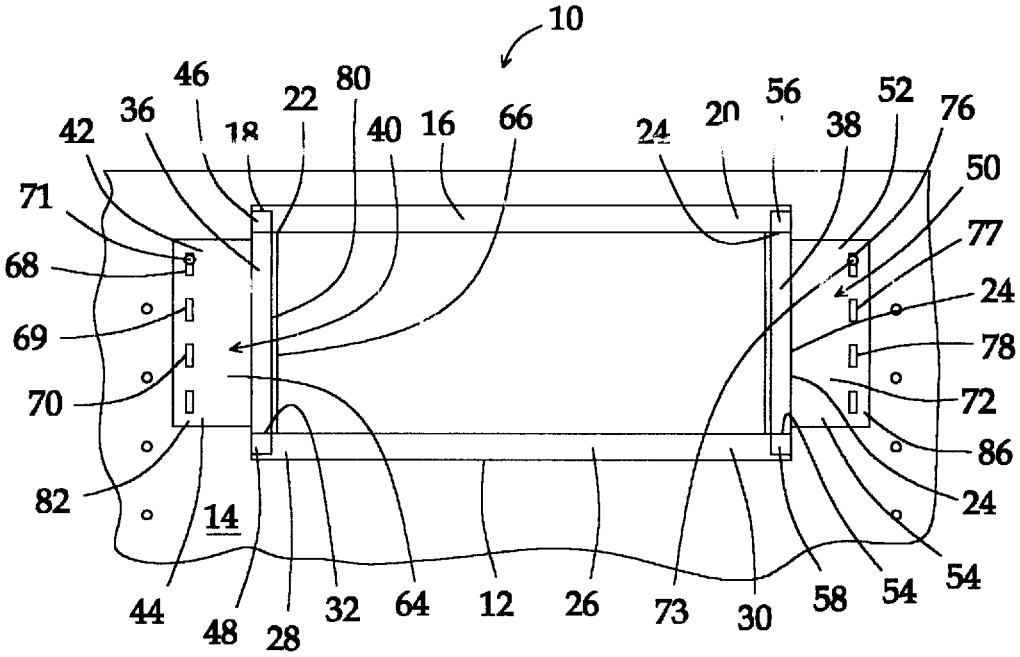
FIG. 2 is a front elevational view of the window frame device shown in FIG. 1.

FIG. 2 is a front elevational view of the window frame device shown in FIG. 1, FIG. 2 shows a sill 26 having a first and a second extremity 28 and 30 respectively, the first and second extremities 28 and 30 defining respectively a first and a second channel 32 and 34 respectively.

A first jamb 36 extends between the first side 18 of the head 16 and the first extremity 28 of the sill 26.

A second jamb 38 extends between the second side 20 of the head 16 and the second extremity 30 of the sill 26.

A first tie adapter generally designated 40 has a first and a second end 42 and 44 respectively. The first end 42 defines a tenon 46 which cooperates with the first slot 22, the second end 44 defining a tab 48 which cooperates with the first channel 32.

A second tie adapter generally designated 50 has a first and a second edge 52 and 54 respectively. The first edge 52 defines a further tenon 56 which cooperates with the second slot 24. The second edge 54 defines a further tab 58 which cooperates with the second channel 34, the arrangement being such that when the tie adapters 40 and 50 are located adjacent to the respective jambs 36 and 38 with the tenons 46 and 56 and tabs 48 and 58 cooperating with the respective slots 22 and 24 and channels 32 and 34, the adjustable setting of the window frame 12 relative to the foundation form 14 is permitted.

In a more specific embodiment of the present invention, the window frame 12 including the head 16, the sill 26 and the jambs 36 and 38 are metallic.

Figure 3:
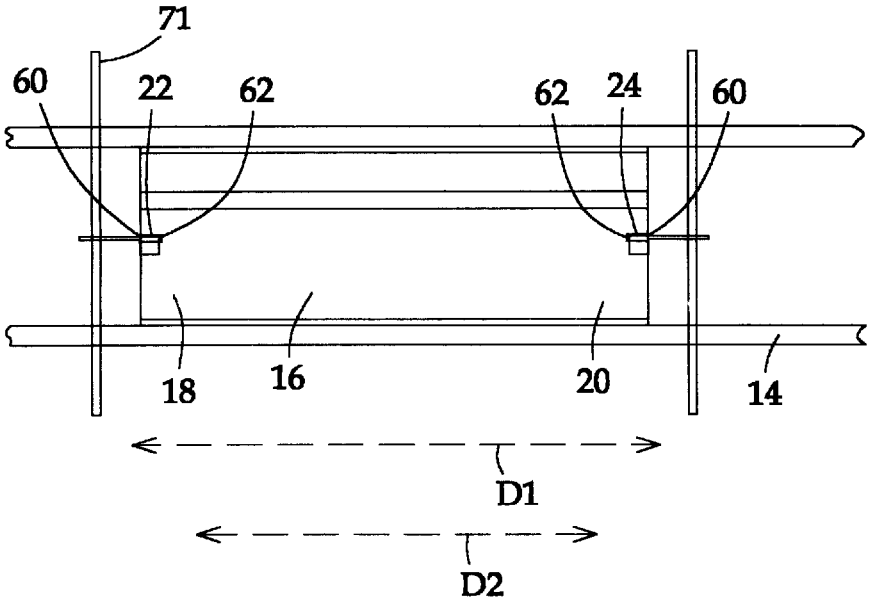
FIG. 3 is a top plan view of the window frame device shown in FIG. 2.

FIG. 3 is a top plan view of the window frame device shown in FIG. 2. More particularly as shown in FIG. 3, the first slot 22 extends in a direction from the first side 18 of the head 16 towards the second side 20 thereof and the second slot 24 extends in a direction from the first side 18 of the head 16 towards the second side 20 thereof.

Figure 4:
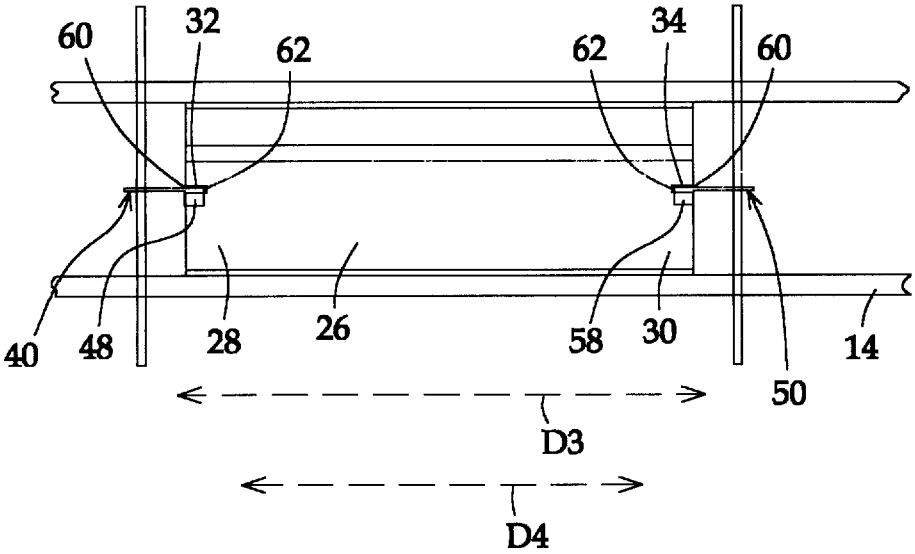
FIG. 4 is a bottom plan view of the window frame device shown in FIG. 2.

FIG. 4 is a bottom plan view of the window frame device shown in FIG. 2. FIG. 4 shows the first channel 32 extending in a direction from the first extremity 28 of the sill 26 towards the second extremity 30 thereof and the second channel 34 extending in a direction from the first extremity 28 of the sill 26 towards the second extremity 30 thereof.

Additionally, each of the slots 22 and 24 and the channels 32 and 34 include an open end 60 and a closed end 62. The open end 60 of the first slot 22 and the open end 60 of the second slot 24 are spaced apart by a first distance D1.

Also, the closed end 62 of the first slot 22 and the closed end 62 of the second slot 24 are spaced apart by a second distance D2, the first distance D1 being greater than the second distance D2.

Moreover, the open end 60 of the first channel 32 and the open end 60 of the second channel 34 are spaced apart by a third distance D3.

Also, the closed end 62 of the first channel 32 and the closed end 62 of the second channel 34 are spaced apart by a fourth distance D4, the third distance D3 being greater than the fourth distance D4.

Normally, the first and third distance D1 and D3 respectively are the same and the second and fourth distance D2 and D4 are the same.

Figure 5:
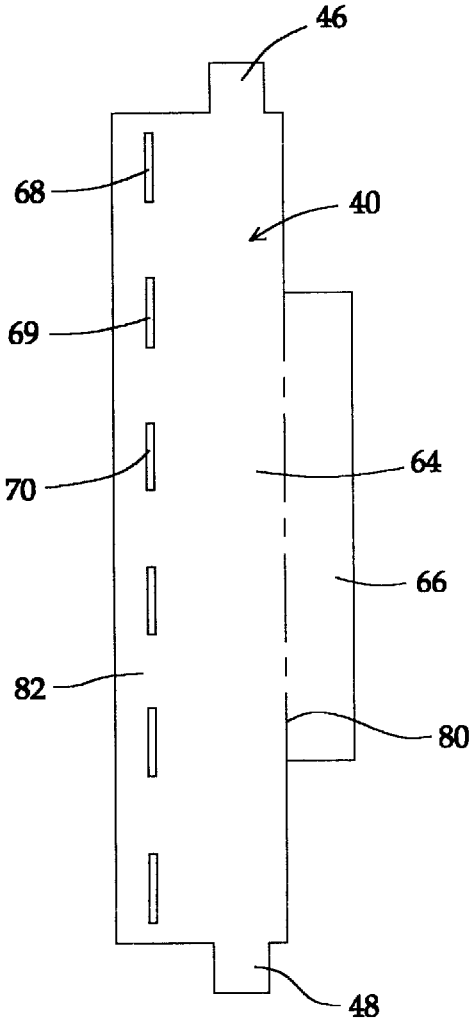
FIG. 5 is an enlarged front elevational view of one of the tie adapters shown in FIG. 2 before the stabilizer is bent angularly relative to the main portion.
Figure 6:
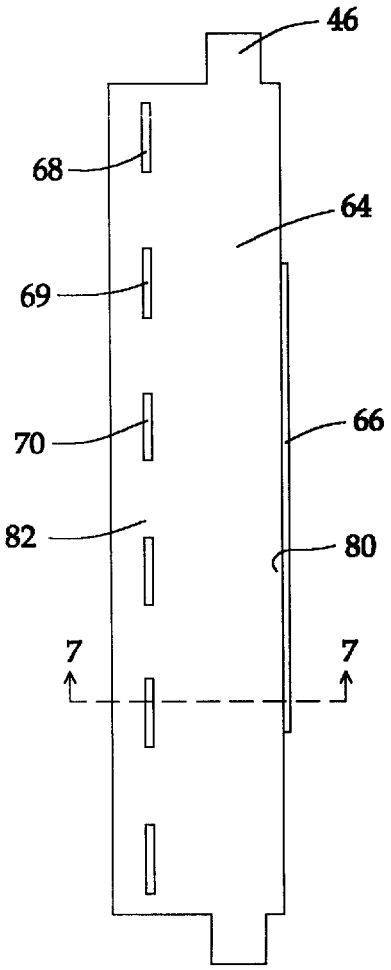
FIG. 6 is a similar view to that shown in FIG. 5 but shows the stabilizer bent relative to the main portion.

FIGS. 5 and 6 are enlarged front elevational views of the adapter 40. As shown in FIG. 5, the first tie adapter 40 further includes a main portion 64 and a stabilizer 66 which extends angularly from the main portion 64 when bent as shown in FIG. 6, the stabilizer 66 cooperating with and laying flat against the first jamb 36 for stabilizing the main portion 64 relative to the window frame 12.

Figure 7:
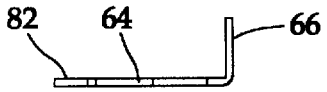
FIG. 7 is a sectional view taken on the line 7—7 of FIG. 6.

FIG. 7 is a sectional view taken on the line 7—7 of FIG. 6 and shows the stabilizer 66 bent relative to the main portion 64.

Also, the main portion 64 defines a plurality of holes 68, 69 and 70 disposed between the first and second end 42 and 44, the holes 68–70 permitting the adjustable fastening of the main portion 64 relative to the foundation form 14 by a form tie 71.

More specifically, the form tie 71 is threaded through one or more of the holes 68–70 so that the window frame is located between an inner and outer metal forms of the foundation form work adjacent to the window opening.

Similarly, the second tie adapter 50 further includes a further main portion 72 and a further stabilizer 74 which extends angularly from the further main portion 72. The further stabilizer 74 cooperates with and lies flat against the second jamb 38 for stabilizing the further main portion 72 relative to the window frame 12.

The further main portion 72 defines a plurality of apertures 76, 77 and 78 disposed between the first and second edge 52 and 54, the apertures 76–78 permitting the adjustable fastening of the further main portion 72 relative to the foundation form 14 as described hereinbefore relative to the fastening of the tie adapter 40 to the form work.

In a specific embodiment, the present invention includes, a form tie adapter device 10 for tieing a basement window frame 12 to a metal foundation form 14, the window frame 12 including a head 16 having a first and a second side 18 and 20 and a sill 26 having a first and a second extremity 28 and 30. The device 10 comprises a first adapter 40 having a first and a second end 42 and 44 and an inner and an outer flank 80 and 82.

The first end 42 further includes a tenon 46 which cooperates with a first slot 22 defined by the first side 18 of the head 16.

The second end 44 further includes a tab 48 which cooperates with a first channel 32 defined by the first extremity 28 of the sill 26.

The first adapter 40 further includes a main portion 64 and a stabilizer 66 which extends angularly from the inner flank 80 for stabilizing the first adapter 40 relative to the window frame 12.

The outer flank 82 defines a plurality holes 68–70, the arrangement being such that the holes 68–70 permit the location and securing of the window frame 12 relative to the foundation form 14.

A second adapter 50 has a first and a second edge 52 and 54 and a further inner and a further outer flank 84 and 86 respectively.

The first edge 52 further includes a further tenon 56 which cooperates with a second slot 24 defined by the second side 20 of the head 16.

Additionally, the second edge 54 further includes a further tab 58 which cooperates with a second channel 34 defined by the second extremity 30 of the sill 26.

The second adapter 50 further includes a further main portion 72 and a further stabilizer 74 which extends angularly from the further inner flank 84 for stabilizing the second adapter 50 relative to the window frame 12.

Furthermore, the further outer flank 86 defines a plurality of apertures 76–78, the arrangement being such that a further form tie 73 is threaded through one of the apertures 76–78 to permit the location and securing of the window frame 12 relative to the foundation form 14.

Also, the adapters may be supplied separately and located within the slots and channels prior to installation in which case, the tenons and tabs are bent over to lock the adapters in place.

However, when the adapters are factory installed, the tenons and tabs are bent over and tack welded to the frame.

In operation of the device according to the present invention, the metal forms are erected in the usual manner with such forms and window frame defining a basement window opening.

A basement window frame, according to the present invention is located within the window opening and a form tie 71 is inserted through one or more of the holes 68–70 so that the first adapter and consequently one of the sides of the window frame is tied between the inner and outer metal forms.

The other side of the window frame is then adjustably supported by inserting a further form tie 73 through one of the apertures 76–78 for adjusting the level and location of the window frame for achieving the correct setting thereof. The form ties locate the window frame between the inner and outer forms.

Next, the concrete is poured so that when such concrete has set, the window frame is correctly aligned relative to the metal forms.

Subsequently, the forms are removed without having to remove any window frame supporting means.

Although the present invention finds application of BUCK WINDOWS (BUF) to metal forms, the present invention is not limited to this type of window frame.

The present invention avoids the need to remove any temporary window frame supporting means because the first and second adapters become invisibly embedded in the set concrete of the poured foundation.

What is claimed is:

1. A window frame device for permitting the adjustable setting of a window frame adjacent to a foundation form, said device comprising:

a window frame which includes:

a head having a first and a second side, said first and second sides defining respectively a first and a second slot;

a sill having a first and a second extremity, said first and second extremities defining respectively a first and a second channel;

a first jamb extending between said first side of said head and said first extremity of said sill;

a second jamb extending between said second side of said head and said second extremity of said sill;

a first tie adapter having a first and a second end, said first end defining a tenon which cooperates with said first slot, said second end defining a tab which cooperates with said first channel; and a second tie adapter having a first and a second edge, said first edge defining a further tenon which cooperates with said second slot, said second edge defining a further tab which cooperates with said second channel, the arrangement being such that when said tie adapters are located adjacent to said respective jambs with said tenons and tabs cooperating with said respective slots and channels, the adjustable setting of said window frame relative to the foundation form is permitted.

2. A window frame device as set forth in claim 1 wherein said head, said sill and said jambs are metallic.

3. A window frame device as set forth in claim 2 wherein said head, said sill and said jambs are factory installed with said tie adapters.

4. A window frame device as set forth in claim 1 wherein said first slot extends in a direction from said first side of said head towards said second side thereof;

said second slot extends in a direction from said first side of said head towards said second side thereof;

said first channel extends in a direction from said first extremity of said sill towards said second extremity thereof;

said second channel extends in a direction from said first extremity of said sill towards said second extremity thereof.

5. A window frame device as set forth in claim 1 wherein each of said slots and said channels include:

an open end and a closed end;

said open end of said first slot and said open end of said second slot are spaced apart by a first distance;

said closed end of said first slot and said closed end of said second slot are spaced apart by a second distance, said first distance being greater than said second distance.

6. A window frame device as set forth in claim 1 wherein said open end of said first channel and said open end of said second channel being spaced apart by a third distance;

said closed end of said first channel and said closed end of said second channel being spaced apart by a fourth distance, said third distance being greater than said fourth distance.

7. A window frame device as set forth in claim 6 wherein said first and third distance are the same;

said second and fourth distance are the same.

8. A window frame device as set forth in claim 1 wherein said first tie adapter further includes:

a main portion;

a stabilizer which extends angularly from said main portion, said stabilizer cooperating with and lying flat against said first jamb for stabilizing said main portion relative to said window frame.

9. A window frame device as set forth in claim 8 wherein said main portion defines a plurality of holes disposed between said first and second end, said holes permitting the adjustable fastening of said main portion relative to the foundation form.

10. A window frame device as set forth in claim 1 wherein said second tie adapter further includes:

a further main portion;

a further stabilizer which extends angularly from said further main portion, said further stabilizer cooperating with and lying flat against said second jamb for stabilizing said further main portion relative to said window frame.

11. A window frame device as set forth in claim 10 wherein said further main portion defines a plurality of apertures disposed between said first and second edge, said apertures permitting the adjustable fastening of said further main portion relative to the foundation form.

12. A form tie adapter device for tieing a basement window frame to a metal foundation form, the window frame including a head having a first and a second side and a sill having a first and a second extremity, said device comprising:

a first adapter having a first and a second end and an inner and an outer flank;

said first end further including;

a tenon which cooperates with a first slot defined by the first side of the head;

said second end further including:

a tab which cooperates with a first channel defined by the first extremity of the sill;

said first adapter further including:

a main portion;

a stabilizer which extends angularly from said inner flank for stabilizing said first adapter relative to the window frame;

said outer flank defining a plurality holes, the arrangement being such that said holes permit the location and securing of the window frame relative to the foundation form;

a second adapter having a first and a second edge and a further inner and a further outer flank;

said first edge further including;

a further tenon which cooperates with a second slot defined by the second side of the head;

said second edge further including:

a further tab which cooperates with a second channel defined by the second extremity of the sill;

said second adapter further including:

a further main portion;

a further stabilizer which extends angularly from said further inner flank for stabilizing said second adapter relative to the window frame; and said further outer flank defining a plurality apertures, the arrangement being such that said apertures permit the location and securing of the window frame relative to the foundation form.

13. A window frame device for permitting the adjustable setting of a window frame adjacent to a metal foundation form, said device comprising:

a window frame which includes:

a head having a first and a second side, said first and second sides defining respectively a first and a second slot;

a sill having a first and a second extremity, said first and second extremities defining respectively a first and a second channel;

a first jamb extending between said first side of said head and said first extremity of said sill;

a second jamb extending between said second side of said head and said second extremity of said sill; and a first tie adapter having a first and a second end, said first end defining a tenon which cooperates with said first slot, said second end defining a tab which cooperates with said first channel; and a second tie adapter having a first and a second edge, said first edge defining a further tenon which cooperates with said second slot, said second edge defining a further tab which cooperates with said second channel, the arrangement being such that when said tie adapters are located adjacent to said respective jambs with said tenons and tabs cooperating with said respective slots and channels, the adjustable setting of said window frame relative to the foundation form is permitted.

* * * * *